US005908886A

United States Patent [19]

Uchida et al.

[11] Patent Number: 5,908,886

[45] **Date of Patent: *Jun. 1, 1999**

[54] METHOD FOR RECOVERING COOLING CHARACTERISTICS OF WATER-SOLUBLE QUENCHING MEDIUM, AND WATER-SOLUBLE QUENCHING MEDIUM WITH RECOVERED COOLING CHARACTERISTICS

[75] Inventors: Hitoshi Uchida, Kawasaki; Eiichi Nakamura, Ichihara, both of Japan

[73] Assignee: Idemitsu Kosan Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/794,934

[22] Filed: Feb. 4, 1997

[30] Foreign Application Priority Data

Feb. 15, 1996 [JP] Japan ..... 8-027938

[51] Int. Cl.[6] ..... C08K 5/06

[52] U.S. Cl. ..... 524/377; 524/376; 524/503; 524/590

[58] Field of Search ..... 524/376, 377, 524/503

[56] References Cited

U.S. PATENT DOCUMENTS

| | | | |
|---|---|---|---|
| 4,087,388 | 5/1978 | Jensen | 260/2.5 |
| 4,133,787 | 1/1979 | Laganis | 524/376 |
| 4,485,131 | 11/1984 | Adams | 524/377 |
| 4,528,316 | 7/1985 | Joerens | 524/503 |
| 4,595,425 | 6/1986 | Harding | 148/18 |
| 4,799,962 | 1/1989 | Ahmed | 524/377 |
| 4,826,545 | 5/1989 | Foreman | 148/18 |
| 4,844,709 | 7/1989 | Marten | 524/377 |
| 5,084,348 | 1/1992 | Czech | 524/377 |
| 5,110,448 | 5/1992 | Adams | 208/131 |
| 5,294,347 | 3/1994 | Byrne | 210/708 |
| 5,445,743 | 8/1995 | Rowe | 210/710 |

*Primary Examiner*—Peter A. Szekely
*Attorney, Agent, or Firm*—Oblon, Spivak, McClelland, Maier & Neustadt, P.C.

[57] ABSTRACT

Disclosed are a method for restoring a water-soluble quenching medium being used, of which the cooling characteristics have been deteriorated during use, to its original condition to have nearly the original cooling characteristics which the fresh medium has before use, and a water-soluble quenching medium thus restored to its original condition to have nearly the original cooling characteristics thereof. The method comprises adding to a quenching bath being used an aqueous solution comprising a water-soluble polymer (B) that has a larger weight average molecular weight than that of the water-soluble polymer (A) existing in the fresh water-soluble quenching medium to be in the fresh bath.

2 Claims, No Drawings

METHOD FOR RECOVERING COOLING CHARACTERISTICS OF WATER-SOLUBLE QUENCHING MEDIUM, AND WATER-SOLUBLE QUENCHING MEDIUM WITH RECOVERED COOLING CHARACTERISTICS

FIELD OF THE INVENTION

The present invention relates to a method for recovering the cooling characteristics of a water-soluble quenching medium(polymer quenchants), and a water-soluble quenching medium with recovered cooling characteristics. Precisely, it relates to a method for restoring a water-soluble quenching medium being used, of which the cooling characteristics have been deteriorated during use, to its original condition to have nearly the original cooling characteristics which the fresh medium has before use, and also relates to a water-soluble quenching medium thus restored to its original condition to have nearly the original cooling characteristics thereof.

BACKGROUND OF THE INVENTION

Heretofore, water-soluble quenching media have been being used widely in the art, as being advantageous in that they cause almost no danger of fire, that they have good cooling characteristics and therefore can be used for quenching even low-grade steel, and that they give little soot which may cause environmental pollution. However, they are problematic in that their cooling rate especially at about 300° C. at which martensite transformation starts is too high, resulting in that the quenched objects often have distortion or cracking. In order to overcome this problem, it has heretofore been attempted to add a water-soluble polymer to the quenching bath containing such a water-soluble quenching medium, thereby controlling the cooling rate in the bath to fall within a suitable range.

However, the polymers in water-soluble quenching media are decomposed under heat or through oxidation during use, whereby the cooling characteristics of the media are varied. Specifically, during use of these media, the vapor blanket stage (in which the vapor as generated through the contact of the medium with the high-temperature metal surfaces of the objects being quenched surrounds entirely the objects with the result that the objects are thereafter cooled only through this vapor wall therearound) is shortened and, in addition, the cooling rate in the boiling stage (in which the quenching liquid is kept in direct contact with the objects being quenched to cause active boiling around the objects, and in which the cooling rate is the highest) is enlarged, thereby resulting in that the objects quenched often have distortion or cracking. If a fresh medium is replenished to the quenching bath, the vapor blanket stage is prolonged so that the cooling characteristics of the medium being used can be recovered, but the cooling rate in the boiling stage could not be reduced to such a degree as expected. Even in this case, after all, the objects as quenched in the bath to which a fresh medium has been replenished have still often distortion or cracking although they may have the same degree of hardness as that of the objects as quenched in a fresh quenching bath. At present, a fresh quenching medium is replenished to the bath being used so as to increase the polymer concentration in the bath, thereby prolonging the vapor blanket stage to such a degree that the quenched objects may have an intended hardness while preventing the quenched objects from cracking. However, even though a fresh quenching medium is replenished to the bath being used, the intended quenching becomes difficult to attain in the bath, while the objects quenched therein still often have cracking to overstep the standard for acceptable objects. If so, the bath thus comprising the deteriorated water-soluble quenching medium must be completely exchanged for a fresh one, which, however, is expensive. Given the situation, it is desired to overcome these problems in the art.

SUMMARY OF THE INVENTION

The present invention has been made in consideration of the above-mentioned matters, and its object is to provide a method for recovering the cooling characteristics of a water-soluble quenching medium being used to thereby restore the quenching medium, of which the cooling characteristics have been deteriorated during use, to its original condition to have nearly the original cooling characteristics which the fresh medium has before use, and also to provide a water-soluble quenching medium thus restored to its original condition to have nearly the original cooling characteristics thereof.

We, the present inventors have assiduously studied in order to attain the above-mentioned object and, as a result, have found that the object can be effectively attained if a water-soluble polymer having a larger weight average molecular weight than that of the water-soluble polymer existing in the fresh water-soluble quenching medium is added to the quenching bath being used. On the basis of this finding, we have completed the present invention.

Specifically, the present invention provides a method for recovering the cooling characteristics of a water-soluble quenching medium in a quenching bath being used, which comprises adding to the bath an aqueous solution comprising a water-soluble polymer (B) that has a larger weight average molecular weight than that of the water-soluble polymer (A) existing in the fresh water-soluble quenching medium.

As one embodiment of the method of the invention, the weight average molecular weight of the water-soluble polymer (B) is from 1.2 to 20 times that of the water-soluble polymer (A).

As another embodiment, the weight average molecular weight of the water-soluble polymer (A) is from 10,000 to 100,000.

As still another embodiment, the water-soluble polymers (A) and (B) are selected from polyvinyl alcohols, polyvinyl pyrrolidones, alkali polyisobutylenemaleates, alkali polyacrylates, polyamides, polyethylene glycols, and polyoxyethylene-propylene polyethers.

The present invention also provides a water-soluble quenching medium with recovered cooling characteristics, which comprises a water-soluble polymer being used, and a water-soluble polymer having a larger weight average molecular weight than that of the former water-soluble polymer before use.

DETAILED DESCRIPTION OF THE INVENTION

Now, the present invention is described in detail hereinunder with reference to the embodiments thereof.

The water-soluble polymer to be in the water-soluble quenching medium of the present invention is not specifically defined provided that it can be used in water-soluble quenching media. Concretely, however, preferred examples of the polymer may be polyvinyl alcohols, polyvinyl pyrrolidones, alkali (e.g., Na or K) polyisobutylenemaleates, alkali (e.g., Na or K) polyacrylates, polyamides, polyethylene glycols and polyoxyethylene-propylene polyethers.

The water-soluble polymer to be in the fresh medium before use may have a weight average molecular weight of preferably from 10,000 to 100,000, more preferably from 30,000 to 60,000. If the weight average molecular weight is smaller than 10,000, the effect of the present invention for reducing the cooling rate in the boiling stage could not almost be expected even though the vapor blanket stage could be prolonged. On the other hand, if it is larger than 100,000, the cooling characteristics of the medium are too much varied through its decomposition under heat, resulting in that the medium could no more be in practical use, although the cooling rate in the boiling stage could be reduced. The weight average molecular weight as referred to herein is one as measured through GPC in terms of polystyrene.

The polymer concentration in the fresh medium before use (as measured in terms of the refractive index) is preferably from2 to 30% by weight, more preferably from3 to 20% by weight. If the concentration is lower than 2% by weight, the effect of the invention for preventing the quenched objects from cracking is low; but if it is higher than 30% by weight, the cooling characteristics of the medium are poor resulting in unsatisfactory quenching of objects with the medium.

The fresh quenching medium before use may optionally contain any additives of, for example, rust inhibitors, defoaming agents, antifungals, and acids or alkalis for pH control, within the range not having any significant negative influences on the cooling characteristics of the medium.

The water-soluble polymer to be added to the water-soluble quenching medium being used shall have a larger weight average molecular weight than the water-soluble polymer that has existed in the fresh medium before use. Preferably, the weight average molecular weight of the former is from 1.2 to 20 times that of the latter, more preferably from 1.7 to 5 times that of the latter. If the weight average molecular weight of the water-soluble polymer to be added is below 1.2 times that of the water-soluble polymer having existed in the fresh medium, the effect of the invention for reducing the cooling rate in the boiling stage could not almost be expected, although the vapor blanket stage could be prolonged. On the other hand, if it is above 20 times, the variation in the cooling characteristics of the medium to be caused by the decomposition of the added polymer under heat is too great to be practicable, even though only a minor amount of the polymer added may exhibit its effect. One or more such water-soluble polymers, which may be the same or different from those in the fresh quenching medium before use, may be added to the quenching bath being used.

The amount of the aqueous solution of such a water-soluble polymer to be added to the quenching bath being used may be preferably from 0.1 to 10% by weight relative to the amount of the water-soluble quenching medium existing in the quenching bath being used, in terms of the refractive index of the bath measured. It is more preferably from 1 to 5% by weight. If the amount is less than 0.1% by weight, the effect of the polymer added for preventing the objects quenched from cracking could not be expected; but if it is more than 10% by weight, the cooling characteristics of the bath to which the polymer has been added are worsened, resulting in that the hardness of the objects quenched in the bath is lower than that of the objects quenched in the fresh bath.

The wording "quenching medium or bath being used" employed herein is referred to. The control of the polymer concentration in a quenching medium is preferably conducted through the measurement of the refractive index and the viscosity of the quenching medium in a bath. Quenching is generally carried out while replenishing a fresh quenching medium and water to the bath being used, but the polymer concentration in the bath as measured in terms of the viscosity of the quenching medium in the bath is lowered with the advance of the quenching being carried out in the bath, resulting in a certain difference between the polymer concentration in the bath in terms of the refractive index of the medium measured and that in terms of the viscosity thereof measured. The quenching bath or medium thus having the difference is meant to be the "quenching bath or medium being used" as referred to herein.

The method of the present invention for recovering the cooling characteristics of the quenching medium in a bath being used can be repeated any desired times, so far as the cooling characteristics of the quenching medium thus processed according to the method can be recovered.

Now, the present invention is described in more detail hereinunder with reference to the following examples, which, however, are not intended to restrict the scope of the present invention.

REFERENCE EXAMPLES 1 AND 2, COMPARATIVE EXAMPLE 1, AND EXAMPLES 1 TO 3

Using any of the water-soluble quenching media as shown in Table 1 below, the cooling curve in a quenching bath was determined according to JIS K2242, from which were obtained the cooling time to be from 800° C. to 200° C. and the mean cooling rate to be from 350° C. to 150° C. The data obtained are shown in Table 2 below.

The cooling time to be from 800° C. to 200° C. may be the criterion that indicates the quenchability. The shorter the time is, the better the quenchability is. The mean cooling rate to be from 350° C. to 150° C. may be the criterion that indicates the prevention of cracking of quenched objects. The smaller the rate is, the smaller the proportion of cracked objects to all objects quenched is.

TABLE 1

| | Water-Soluble Quenching Medium |
|---|---|
| Reference Example 1 | Fresh water-soluble quenching medium comprising PAG with a weight average molecular weight of 40,000 (polymer concentration: 10% by weight) |
| Reference Example 2 | Used water-soluble quenching medium comprising PAG with a weight average molecular weight of 40,000 (polymer concentration: 15% by weight) |
| Comparative Example 1 | 4% by weight of the fresh medium of Reference Example 1 was added to the used medium of Reference Example 2 |
| Example 1 | 1.5 % by weight of PAG with a weight average molecular weight of 83,000 was added to the used medium of Reference Example 2 |
| Example 2 | 3.0% by weight of PAG with a weight average molecular weight of 83,000 was added to the used medium of Reference Example 2 |
| Example 3 | 1.5% by weight of PAG with a weight average molecular weight of 60,000 was added to the used medium of Reference Example 2 |

*1) PAG: Polyoxyethylene-propylene polyether

*2) Weight average molecular weight: Measured by GPC in terms of polystyrene.

*3) Polymer concentration: Measured in terms of the refractive index of each medium.

*4) The amount of the polymer added is relative to the whole amount of the medium before the addition (as measured in terms of the refractive index of the medium).

TABLE 2

| | 800/200 (sec) | 350/150 (° C./sec) |
|---|---|---|
| Reference Example 1 | 10.5 | 65 |
| Reference Example 2 | 11.0 | 130 |
| Comparative Example 1 | 14.5 | 125 |
| Example 1 | 11.5 | 85 |
| Example 2 | 11.6 | 62 |
| Example 3 | 11.2 | 100 |

*1) 800/200 (sec): Cooling time to be from 800° C. to 200° C.
*2) 350/150 (° C./sec): Mean cooling rate to be from 350° C. to 150° C.

The data in Table 2 verify the following facts:

REFERENCE EXAMPLE 1

Since the mean cooling rate to be from 350° C. to 150° C. was small, the proportion of cracked objects to all objects quenched may be small.

REFERENCE EXAMPLE 2

Comparing the used medium with the fresh medium, the mean cooling rate with the former was larger than that with the latter, though the cooling time to be from 800° C. to 200° C. did not almost differ between the two. Therefore, the hardness of the objects quenched with the former, used medium may be comparable to that of the objects quenched with the latter, fresh medium, but the objects quenched with the former may have cracking more than those quenched with the latter.

COMPARATIVE EXAMPLE 1

The addition of the fresh medium to the used medium may prolong the vapor blanket stage, but was almost ineffective for reducing the mean cooling rate to be from 350° C. to 150° C. Using this sample, therefore, objects will be hardly quenched. In addition, the addition of the fresh medium will be almost ineffective for preventing quenched objects from cracking.

EXAMPLES 1 AND 2

The addition of the polymer resulted in the reduction in the mean cooling rate to be from 350° C. to 150° C., without almost prolonging the vapor blanket stage. When the amount of the polymer added was increased up to 3% by weight, the used medium was almost completely restored to its original condition of the fresh medium.

EXAMPLE 3

The polymer added herein has a molecular weight somewhat smaller than that of the polymer added in Examples 1 and 2. Therefore, the effect of the polymer added herein was not so much good, as compared with that of the polymer added in Examples 1 and 2. However, when compared with the sample of Comparative Example 1 where the same polymer having the same molecular weight as that of the polymer in the fresh medium was added to the used medium, the cooling characteristics of the sample of this Example 3 were much more improved than those of the sample of Comparative Example 1.

As has been described in detail hereinabove with reference to some embodiments thereof, the method of the present invention is effective for recovering the cooling characteristics of a water-soluble quenching medium that has been deteriorated during use nearly to the original cooling characteristics of the fresh medium.

While the invention has been described in detail and with reference to specific embodiments thereof, it will be apparent to one skilled in the art that various changes and modifications can be made therein without departing from the spirit and scope thereof.

What is claimed is:

1. In a method of quenching a steel with a water-soluble quenching medium in a quenching bath, the improvement for recovering the cooling characteristics of a water-soluble quenching medium of said quenching bath after having been used to quench a steel, which comprises quenching steel with a quenching bath of an aqueous solution comprising a water-soluble polymer (A), adding to said quenching bath after having been used to quench said steel, an aqueous solution comprising a water-soluble polymer (B) that has a weight average molecular weight of from 1.2 to 20 times of the average molecular weight of the water-soluble polymer (A) existing in the originally used water-soluble quenching medium to nearly restore its original cooling characteristics, said water-soluble polymer (A) having a weight average molecular weight of from 10,000 to 100,000, and after having added thereto said water-soluble polymer (B) again quenching a steel with the resulting quenching medium, and wherein the amount of the aqueous solution of polymer (B) added is from 0.1 to 10% by weight relative to the amount of water-soluble quenching medium in the quenching bath being used, wherein said water-soluble polymer is a polyoxyethylene-propylene polyether.

2. The method as claimed in claim 1, wherein the amount of the aqueous solution of polymer (B) added is from 0.1 to 5% by weight relative to the amount of water-soluble quenching medium in the quenching bath being used.

* * * * *